US007603989B2

(12) United States Patent
Matsumoto et al.

(10) Patent No.: US 7,603,989 B2
(45) Date of Patent: Oct. 20, 2009

(54) FUEL FEED APPARATUS HAVING FUEL PUMP

(75) Inventors: Noriya Matsumoto, Okazaki (JP); Kouji Izutani, Nagoya (JP); Keiichi Yamashita, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/317,304

(22) Filed: Dec. 27, 2005

(65) Prior Publication Data

US 2006/0137662 A1 Jun. 29, 2006

(30) Foreign Application Priority Data

Dec. 28, 2004 (JP) ..... 2004-378679

(51) Int. Cl.
*F02M 37/04* (2006.01)

(52) U.S. Cl. ..... 123/509; 417/363; 137/565.24

(58) Field of Classification Search ..... 123/509, 123/516, 495; 417/363; 137/565.24
See application file for complete search history.

(56) References Cited

U.S. PATENT DOCUMENTS

| | | | | |
|---|---|---|---|---|
| 3,362,588 | A * | 1/1968 | Jeep, Jr. et. al. | 222/385 |
| 4,306,844 | A * | 12/1981 | Otto et al. | 417/423.14 |
| 5,044,526 | A * | 9/1991 | Sasaki et al. | 222/377 |
| 5,511,957 | A * | 4/1996 | Tuckey et al. | 417/313 |
| 5,992,394 | A | 11/1999 | Mukaidani et al. | |
| 6,138,524 | A * | 10/2000 | Tsuda et al. | 73/866.5 |
| 6,206,037 | B1 | 3/2001 | Murakoshi et al. | |
| 6,230,690 | B1 * | 5/2001 | Umetsu | 123/509 |
| 6,981,490 | B2 * | 1/2006 | Nagata et al. | 123/514 |
| 2001/0001963 | A1 | 5/2001 | Murakoshi et al. | |
| 2001/0047827 | A1 | 12/2001 | Murakoshi et al. | |

FOREIGN PATENT DOCUMENTS

| | | |
|---|---|---|
| GB | 2231384 | 11/1990 |

(Continued)

OTHER PUBLICATIONS

Japanese Office Action dated Jan. 26, 2009, issued in corresponding Japanese Application No. 2004-378679, with English translation.

(Continued)

*Primary Examiner*—Stephen K Cronin
*Assistant Examiner*—J. Page Hufty
(74) *Attorney, Agent, or Firm*—Nixon & Vanderhye P.C.

(57) ABSTRACT

A fuel feed apparatus pumps fuel in a fuel tank to an outside of the fuel tank. The fuel feed apparatus includes a lid member that covers an opening formed in the fuel tank. The lid member includes an outlet passage, through which fuel passes to the outside of the fuel tank. A pump module is accommodated in the fuel tank. The pump module is supported by the lid member. The pump module includes a fuel pump that pumps fuel in the fuel tank to the outside of the fuel tank. A pipe member connects with a pipe connecting portion of the outlet passage and a pipe connecting portion of the pump module. The pipe member introduces fuel discharged from the pump module to the outlet passage. The pipe connecting portion of the outlet passage and the pipe connecting portion of the pump module are substantially perpendicular to an axis of the lid member.

25 Claims, 5 Drawing Sheets

FOREIGN PATENT DOCUMENTS

| | | |
|---|---|---|
| JP | U-52-092409 | 7/1977 |
| JP | U-54-038717 | 3/1979 |
| JP | A-10-054320 | 2/1998 |
| JP | 2001-082277 | 3/2001 |
| JP | A-2001-214827 | 8/2001 |
| JP | A-2003-269277 | 9/2003 |

OTHER PUBLICATIONS

Japanese Office Action mailed Sep. 17, 2008, issued in counterpart Japanese Application No. 2004-378679, with English translation.

* cited by examiner

FUEL FEED APPARATUS HAVING FUEL PUMP

CROSS REFERENCE TO RELATED APPLICATIONS

This application is based on and incorporates herein by reference Japanese Patent Applications No. 2004-378679 filed on Dec. 28, 2004.

FIELD OF THE INVENTION

The present invention relates to a fuel feed apparatus that pumps fuel in a fuel tank to the outside of the fuel tank.

BACKGROUND OF THE INVENTION

According to JP-A-11-101166 (U.S. Pat. No. 5,992,394), an in-tank type fuel feed apparatus has a pump module including a fuel pump accommodated in a fuel tank. The fuel pump pumps fuel in the fuel tank. The fuel feed apparatus includes a lid member that covers an opening formed in the fuel tank. The pump module pumps fuel that is supplied to the outside of the fuel tank through a pipe member and an outlet passage of the lid member. The pipe member connects the pump module with the lid member.

In this fuel feed apparatus, the pipe member has one end that connects with a pipe connecting portion of the pump module. The pipe member has the other end that connects with a pipe connecting portion of the outlet passage of the lid member. The pipe connecting portion of the pump module extends from the pump module in the axial direction of the lid member. The pipe connecting portion of the lid member extends from the lid member in the axial direction of the lid member. That is, the pipe connecting portion of the pump module protrudes from the pump module to the side of the lid member. The pipe connecting portion of the outlet passage of the lid member protrudes from the lid member to the side of the pump module. In this structure, assembling work of the pipe member is facilitated, and installation work of the fuel feed apparatus into the fuel tank is also facilitated.

However, in the above fuel feed apparatus, the pipe connecting portions respectively protrude heightwise in the depth direction of the fuel tank. Accordingly, the pipe connecting portions are apt to cause interference with each other. Besides, the pipe connecting portions are apt to cause interference with other components. Accordingly, the fuel feed apparatus needs to have enough height in the depth direction of the fuel tank, consequently the height of the fuel feed apparatus is apt to increase. In recent years, flat fuel tanks, which are narrow in height, are used to secure a space in the vehicle. Therefore, it is necessary to reduce the height of the fuel feed apparatus.

SUMMARY OF THE INVENTION

In view of the foregoing and other problems, it is an object of the present invention to produce a small-sized fuel feed apparatus.

According to one aspect of the present invention, a fuel feed apparatus pumps fuel in a fuel tank to an outside of the fuel tank. The fuel feed apparatus includes a lid member, a pump module, and a pipe member. The lid member covers an opening formed in a wall of the fuel tank. The lid member includes an outlet passage, through which fuel passes to the outside of the fuel tank. The pump module is accommodated in the fuel tank. The pump module is supported by the lid member. The pump module includes a fuel pump, which pressurizes fuel in the fuel tank. The pump module pumps fuel in the fuel tank to the outside of the fuel tank. The pipe member connects with a pipe connecting portion of the outlet passage and a pipe connecting portion of the pump module. The pump module discharges fuel to the outlet passage of the lid member through the pipe member. The pipe connecting portion of the outlet passage and the pipe connecting portion of the pump module are substantially perpendicular to an axis of the lid member.

In this structure, the pipe connecting portions and the bellows pipe can be received in the small space. Therefore, the height of the fuel feed apparatus can be reduced with respect to the depth direction of the fuel tank. Thus, the fuel feed apparatus can be installed in the flat fuel tank.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
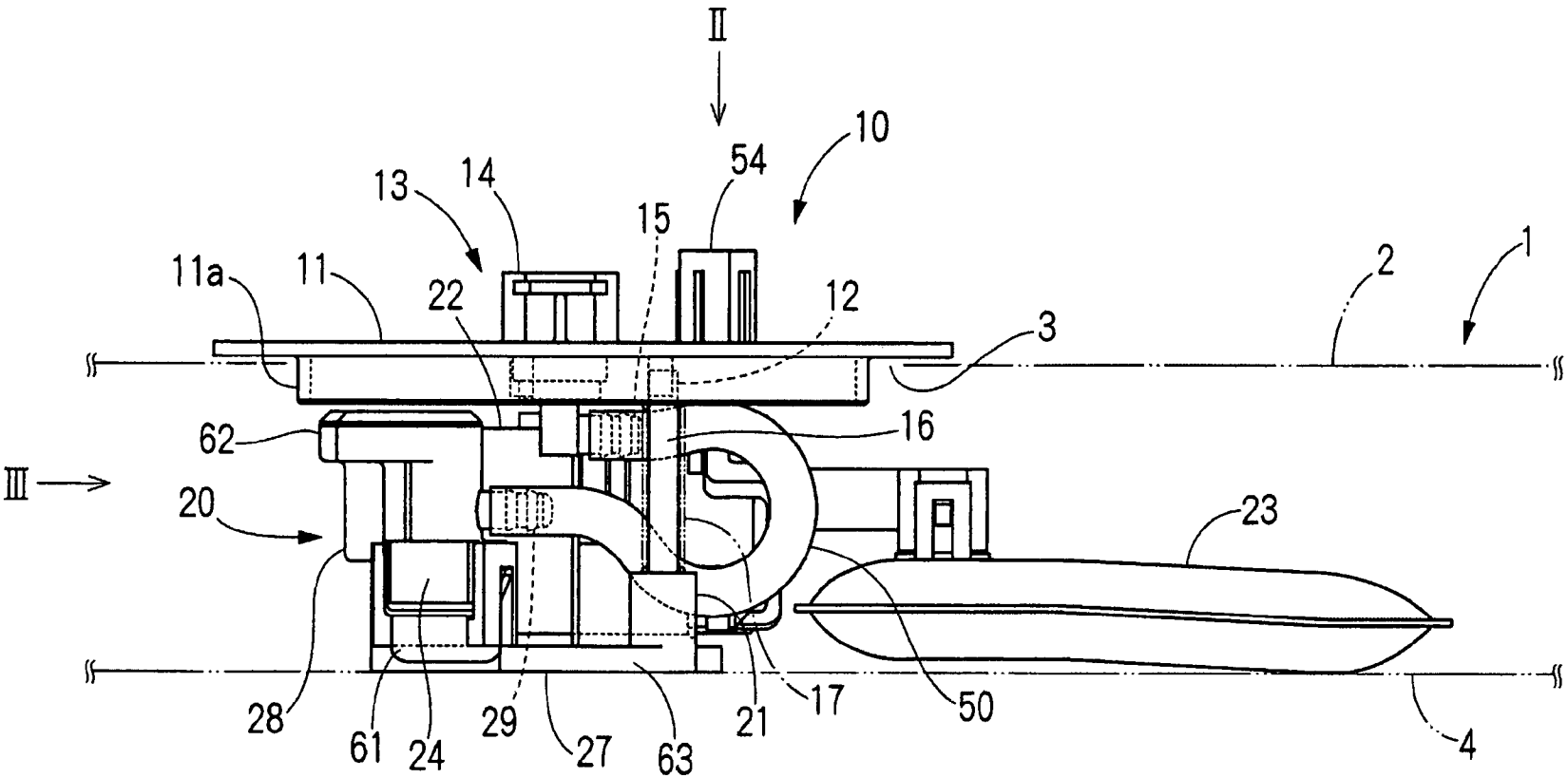
FIG. 1 is a side view showing a fuel feed apparatus according to a first embodiment of the present invention.
Figure 2:
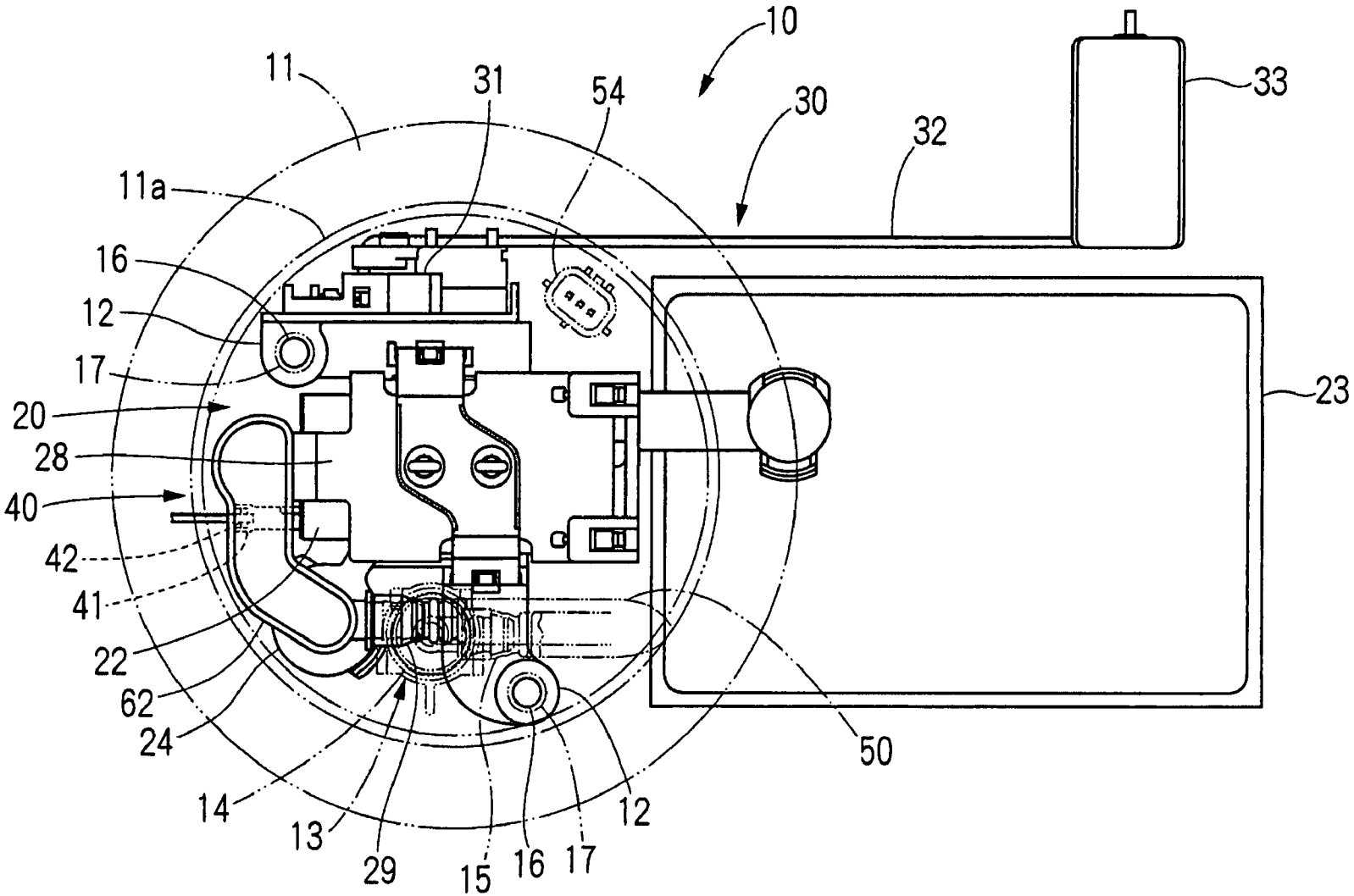
FIG. 2 is a top view showing the fuel feed apparatus when being viewed from the arrow II in FIG. 1.
Figure 3:
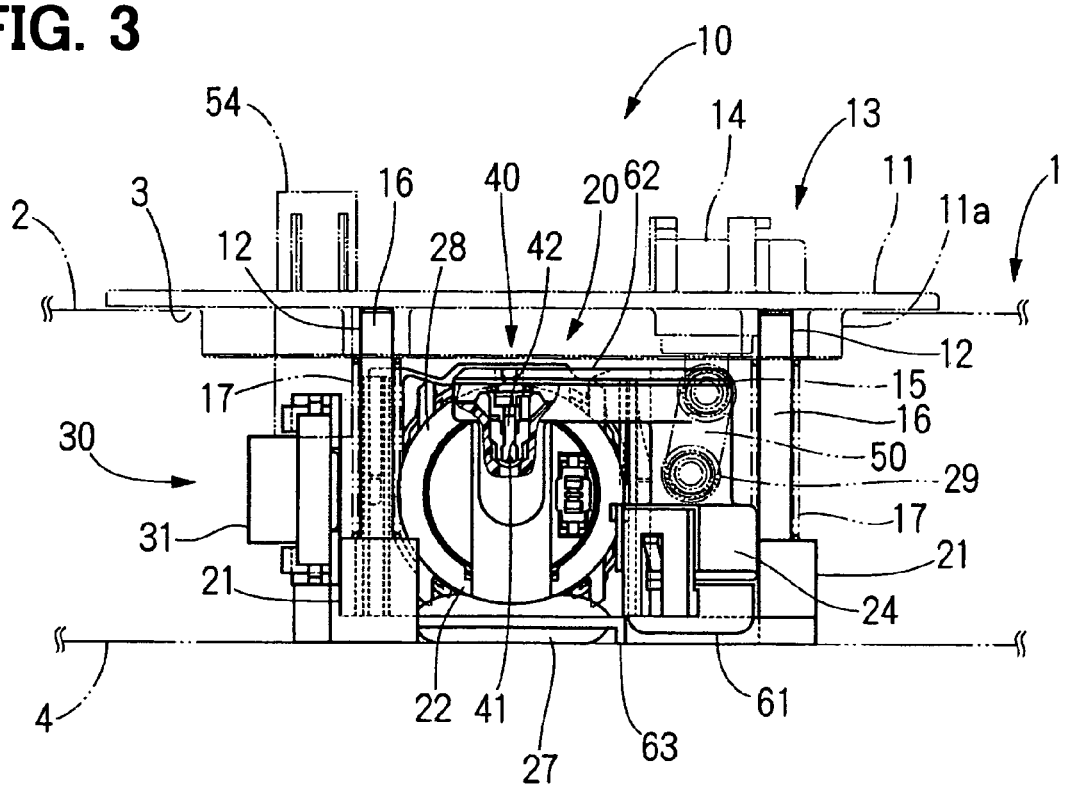
FIG. 3 is a side view showing the fuel feed apparatus when being viewed from the arrow III in FIG. 1.

As shown in FIGS. 1 to 3, a fuel feed apparatus 10 is installed in a fuel tank 1. The fuel feed apparatus 10 pumps fuel in the fuel tank to an engine (not shown). The fuel feed apparatus 10 includes a lid member 11, a pump module 20, and a bellows pipe (pipe member) 50.

The lid member 11 covers an opening formed in an upper wall 2 of the fuel tank 1. The lid member 11 is formed in a substantially disc-shape. The lid member 11 includes a press-insertion portion 12 and an outlet passage 13. The outlet passage 13 introduces fuel discharged from the fuel tank 1 using the pump module 20 to the outside of the fuel tank 1. The outlet passage 13 includes an external connecting portion 14 and a pipe connecting portion 15. The external connecting portion 14 is exposed from the lid member 11 to the outside of the fuel tank 1. The pipe connecting portion 15 protrudes to the inside of the fuel tank 1. The pipe connecting portion 15 connects with an end portion of the bellows pipe 50 on the side opposite to the pump module 20. The pipe connecting portion 15 extends substantially perpendicularly to the center axis of the lid member. That is, the pipe connecting portion 15 is substantially perpendicular to the depth direction of the fuel tank 1. The pipe connecting portion 15 is substantially in parallel with the upper wall 2 of the fuel tank 1. When the pipe connecting portion 15 is substantially perpendicular to the center axis of the lid member 11, the pipe connecting portion 15 may be inclined relative toward the center axis of the lid member 11 such that interference among the pipe connecting portion 15 and other components is reduced.

Shafts 16 support the pump module 20. Each of the shafts 16 has one end that is press-inserted into the press-inserted portion 12 of the lid member 11. Each of the shafts 16 has the other end that is loosely inserted into a supporting portion 21 of the pump module 20. As referred to FIGS. 2, 3, the shafts 16 are arranged on two end portions of the lid member 11, so that the pump module 20 is supported by the lid member 11 via the shafts 16. A spring (resilient member) 17 is provided to the outer circumferential periphery of each shaft 16. The spring 17 has one end that makes contact with the press-inserted portion 12 of the lid member 11. The spring 17 has the other end that makes contact with the supporting portion 21 of the pump module 20. The spring 17 biases the lid member 11 and the pump module 20 such that the lid member 11 departs from the pump module 20. In this structure, the spring 17 presses the pump module 20 onto the bottom wall 4 of the fuel tank 1, even when the fuel tank 1 accommodating the pump module 20 expands or shrinks due to variation in pressure therein and variation in an amount of fuel therein. The variation in pressure in the fuel tank 1 may be caused due to a variation in temperature.

The pump module 20 includes a fuel pump 22, a suction filter 23, a pressure regulator 24, a sender gauge 30, a holder 61, a base 63, an elastic member 27, a check valve 40, and the like. The fuel pump 22 is accommodated in a housing 28. The fuel pump 22 includes a motor and a rotation member such as an impeller that is rotated by the motor. When the rotation member is rotated using the motor, the impeller generates suction pressure, so that the fuel pump 22 draws fuel through the suction filter 23. The suction filter 23 removes foreign matters contained in fuel. The fuel pump 22 pressurizes fuel and discharges the fuel. The fuel pump 22 has the center axis that is substantially perpendicular to the center axis of the lid member 11. Therefore, the fuel pump 22 is installed in the fuel tank 1 such that the center axis of the fuel tank 22 is substantially perpendicular to the depth direction of the fuel tank 1. That is, the fuel tank 22 is arranged substantially horizontally with respect to the depth direction of the fuel tank 1.

Fuel discharged from the fuel pump 22 is introduced into the pressure regulator 24, which controls pressure of fuel discharged from the fuel pump 22 at a substantially constant pressure. The pressure regulator 24 has an outlet port that has a pipe connecting portion 29 on the side of the pump module 20. The pipe connecting portion 29 extends substantially perpendicularly to the center axis of the lid member 11, similarly to the pipe connecting portion 15 of the lid member 11. The bellows pipe 50 has the end portion on the opposite side of the outlet passage 13 of the lid member 11. This end portion of the bellows pipe 50 connects with the pipe connecting portion 29 on the side of the pump module 20. In this structure, the bellows pipe 50 connects the pipe connecting portion 29 on the side of the pump module 20 with the pipe connecting portion 15 of the outlet passage 13 provided to the lid member 11. Fuel is pressure-controlled in the pressure regulator 24, and the fuel is introduced to the pipe connecting portion 15 of the lid member 11 through the bellows pipe 50, so that the fuel is supplied to the engine. When the pipe connecting portion 29 on the side of the pump module 20 is substantially perpendicular to the center axis of the lid member 11, the pipe connecting portion 29 may be inclined toward the center axis of the lid member 11 such that interference is reduced among the pipe connecting portion 29, the bellows pipe 50, and other components.

As referred to FIG. 2, the bellows pipe 50 is arranged on the inner side with respect to an outer periphery 11*a* of the lid member 11. The outer periphery 11*a* of the lid member 11 makes contact with the inner wall of the opening 3 in the fuel tank 1. The bellows pipe 50 does not protrude radially outwardly beyond the outer periphery 11*a* of the lid member 11. In this structure, when the fuel feed apparatus 10 including the bellows pipe 50 is installed to the inside of the fuel tank 1 through the opening 3 of the fuel tank 1, the bellows pipe 50 can be restricted from causing interference with the fuel tank 1. That is, the bellows pipe 50 can be restricted from making contact with the fuel tank 1 having the opening 3, so that the bellows pipe 50 can be restricted from being damaged.

The sender gauge 30 detects the liquid level of fuel in the fuel tank 1. The sender gauge 30 includes a detecting device 31, an arm 32, and a float 33. The detecting device 31 is fixed to the housing 28. The arm 32 is supported using the detecting device 31 such that the arm 32 is rotatable around the detecting device 31 in the vertical direction of the fuel tank 1. The float 33 is supported by the end portion of the arm 32 on the opposite side of the detecting device 31. The float 33 floats in fuel in the fuel tank 1, and vertically moves in the fuel tank 1 in accordance with a variation in the liquid level of fuel in the fuel tank 1. The arm 32 rotates around the detecting device 31 in accordance with the vertical movement of the float 33, so that a contact condition between the detecting device 31 and the arm 32 changes. The detecting device 31 has multiple wiring portions that respectively have electric resistances, which are different from each other. When the contact condition between the detecting device 31 and the arm 32 changes, the electric resistance of the detecting device 31 changes, so that the sender gauge 30 transmits the liquid level of fuel in the fuel tank 1 as a signal indicating an amount of fuel remaining in the fuel tank 1.

As referred to FIG. 1, the holder 61 is arranged on the opposite side of the lid member 11 with respect to the pressure regulator 24. The holder 61 supports the pressure regulator 24 from the side opposite to the lid member 11. A cap 62 at least partially accommodates the fuel pump 22, the heck valve 40, and the pressure regulator 24, together with the housing 28. The cap 62 has a fuel passage communicating from the fuel pump 22 to the pressure regulator 24 through the check valve 40. The base 63 is interposed between the pump module 20 and the bottom wall 4 of the fuel tank 1 on the opposite side of the lid member 11. The base 63 is assembled integrally with the housing 28 of the pump module 20. The base 63 makes contact with bottom wall 4 of the fuel tank 1, so that the base 63 supports the pump module 20 on the bottom wall 4 of the fuel tank 1 on the opposite side of the lid member 11.

As referred to FIG. 3, the base 63 is formed integrally with the elastic member 27. The elastic member 27 is formed of a flexible material such as non-woven fabric and rubber, so that the elastic member 27 is capable of absorbing vibration. In this structure, the flexible elastic member 27 is arranged between the pump module 20 and the bottom wall 4 of the fuel tank 1. In this structure, vibration caused by the pump module 20 is absorbed by the elastic member 27 before being transmitted to the bottom wall 4 of the fuel tank 1. Thus, vibration and noise transmitted from the pump module 20 to the outside of the fuel tank 1 via the bottom wall 4 of the fuel tank 1 can be reduced.

The check valve 40 restricts fuel from flowing to the fuel pump 22 from the side of the engine in the reverse direction. The check valve 40 includes a valve plug 42 that opens and closes a valve passage 41. The fuel pump 22 starts, so that the valve plug 42 opens the valve passage 41. The fuel pump 22 stops, so that the valve plug 42 blocks the valve passage 41.

That is, when the fuel pump 22 starts, so that pressure in fuel on the side of the fuel pump 22 increases, the valve plug 42 is lifted upwardly in FIG. 3, thereby opening the valve passage 41. By contrast, when the fuel pump 22 stops, so that pressure in fuel on the side of the fuel pump 22 decreases, the valve plug 42 is seated downwardly in FIG. 3 due to the weight thereof. Thus, the valve plug 42 blocks the valve passage 41. When the fuel pump 22 stops, the check valve 40 blocks the fluid passage. In this condition, fuel flowing through the bellows pipe 50, the outlet passage 13, and the fluid passage on the side of the engine is restricted from reverse flowing to the side of the fuel tank 1. By contrast, when the fuel pump 22 starts, fuel discharged from the fuel pump 22 is immediately supplied to the engine. Thus, a time lag between starting the fuel pump 22 and starting supplying fuel into the engine can be reduced.

As referred to FIG. 3, the check valve 40 has the center axis that is substantially in parallel with the center axis of the lid member 11. In this structure, the check valve 40 can steadily open and close the valve passage 41 by the weight of the valve plug 42. The check valve 40 is small with respect to the vertical direction in FIG. 3. Therefore, even when the check valve 40 is arranged substantially in parallel with the center axis of the lid member 11, the pump module 20 can be restricted from being jumboized.

In this embodiment, both end portions of the bellows pipe 50 connect to the pipe connecting portions 15, 29 that extend substantially perpendicular to the center axis of the lid member 11 in the fuel feed apparatus 10. Therefore, interference between the pipe connecting portion 15 and the pipe connecting portion 29 can be reduced. Besides, interference among the pipe connecting portion 15, the pipe connecting portion 29 and other components can be also reduced. Thus, in this structure, the pipe connecting portions 15, 29, and the bellows pipe 50 are received in the small space between the lid member 11 and the pump module 20, without causing interference thereamong. Therefore, the height of the fuel feed apparatus 10 can be reduced vertically in FIG. 1, with respect to the depth direction of the fuel tank 1. Thus, the fuel feed apparatus 10 can be installed in the flat fuel tank 1.

Furthermore, in this embodiment, the bellows pipe 50 is arranged on the inner side with respect to the outer periphery 11*a* of the lid member 11. That is, the bellows pipe 50 is arranged on the inner side with respect to the projection plane of the outer periphery 11*a* of the lid member 11, so that the bellows pipe 50 can be restricted from protruding radially outwardly from the lid member 11. In this structure, the fuel feed apparatus 10 including the bellows pipe 50 can be smoothly inserted into the fuel tank 1 through the opening 3 of the fuel tank 1. Thus, installation work of the fuel feed apparatus 10 into the fuel tank 1 can be facilitated.

Second Embodiment

Figure 4:
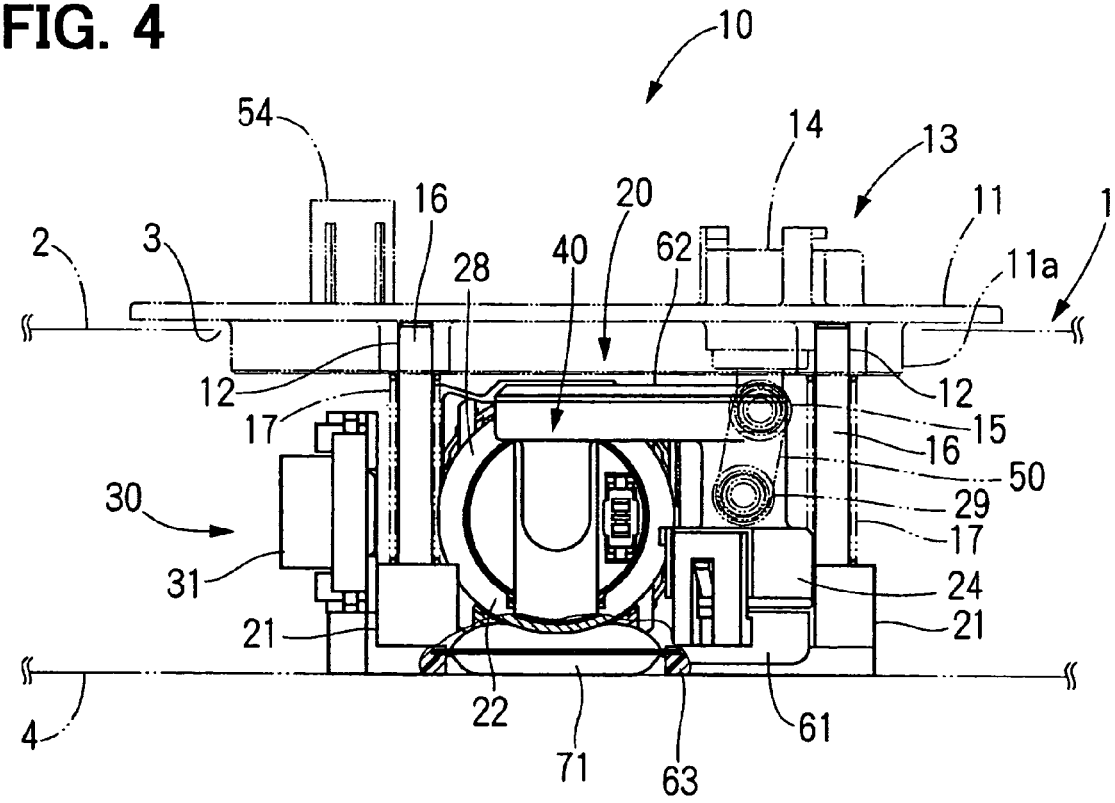
FIG. 4 is a side view showing a fuel feed apparatus according to a second embodiment of the present invention.

As shown in FIG. 4, an elastic member is covered with a non-woven fabric 71. The non-woven fabric 71 is formed integrally with the base 63, which is formed of resin. Specifically, the non-woven fabric 71 is insert-molded of resin in the base 63, so that the non-woven fabric 71 is formed integrally with the base 63. Thus, the non-woven fabric 71 and the base 63 can be integrally formed in a simple structure.

In this second embodiment, the non-woven fabric 71, which is integrated with the base 63, is interposed between the pump module 20 and the bottom wall 4 of the fuel tank 1. Therefore, vibration cause by the pump module 20 is absorbed by the non-woven fabric 71, so that the vibration is restricted from being transferred to the bottom wall 4 of the fuel tank 1. Thus, vibration transferred from the pump module 20 to the bottom wall 4 of the fuel tank 1 can be restricted from being leaked to the outside of the fuel tank 1. As a result, the vibration and noise caused by the fuel feed apparatus 10 can be reduced.

Third Embodiment

Figure 5:
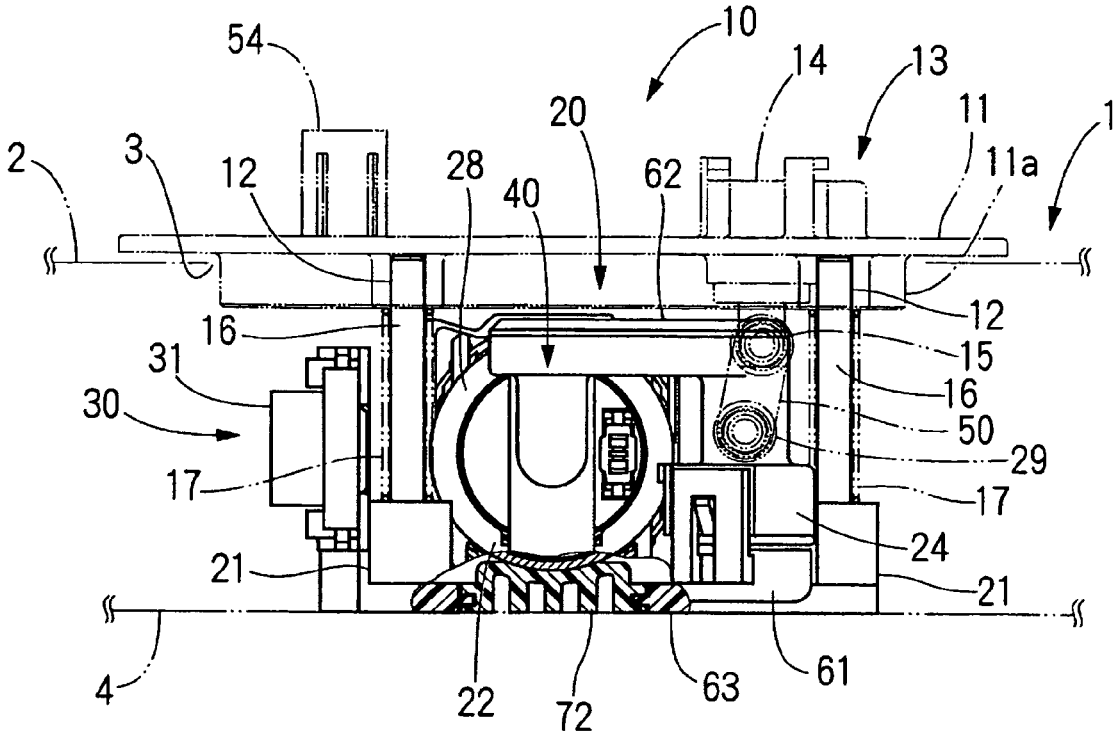
FIG. 5 is a side view showing a fuel feed apparatus according to a third embodiment of the present invention.

As shown in FIG. 5, the elastic member is constructed of a rubber mold member 72. The rubber mold member 72 engages with the base 63 that is formed of resin. The rubber mold member 72 engages with the base 63, thereby, being integral with the base 63. In this structure, the base 63 can be assembled to the rubber mold member 72 in a simple structure.

In this third embodiment, the rubber mold member 72 assembled to the base 63 is interposed between the pump module 20 and the bottom wall 4 of the fuel tank 1. Therefore, vibration caused by the pump module 20 is absorbed by the rubber mold member 72, so that the vibration is restricted from being transferred to the bottom wall 4 of the fuel tank 1. Thus, vibration transferred from the pump module 20 to the bottom wall 4 of the fuel tank 1 can be restricted from being leaked to the outside of the fuel tank 1. As a result, the vibration and noise caused by the fuel feed apparatus 10 can be reduced.

Fourth Embodiment

Figure 6:
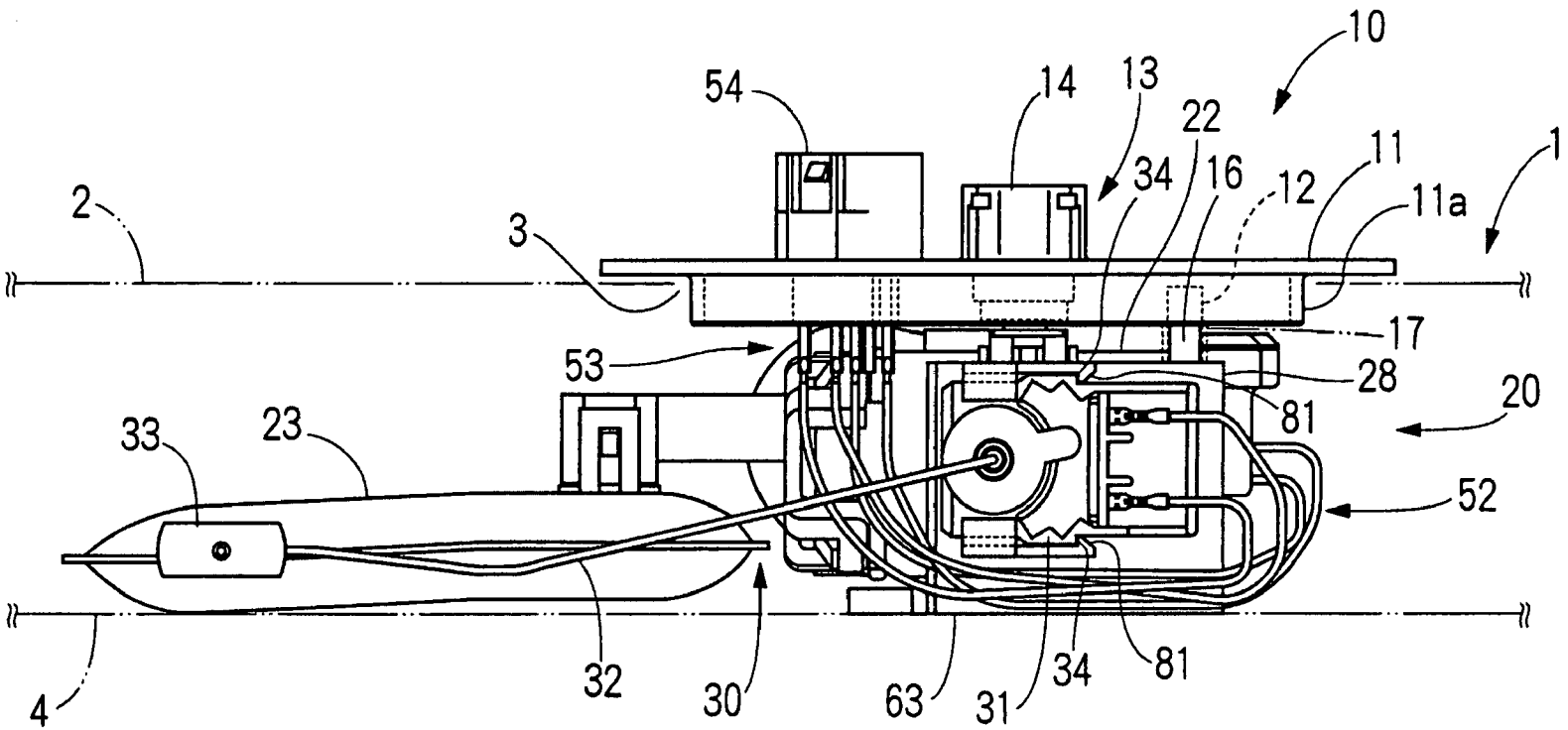
FIG. 6 is a side view showing a fuel feed apparatus according to a fourth embodiment of the present invention.

As shown in FIG. 6, the fuel feed apparatus 10 includes the pump module 20 including the fuel pump 22 and an electrically connecting members 52. The electrically connecting members 52 have one end portions that connect with the fuel pump 22 and the sender gauge 30. The electrically connecting members 52 have the other end portions that connect with terminals 53 that are provided to the lid member 11. The lid member 11 includes the terminals 53 and a connector 54. The connector 54 is exposed from the lid member 11 to the outside of the fuel tank 1. By contrast, the terminals 53 protrude from the lid member 11 to the inside of the fuel tank 1. The terminals 53 electrically connect with the connector 54. The terminals 53 connect with a plug (not shown), so that the fuel feed apparatus 10 electrically connects with an ECU (electronic control unit, not shown).

In this embodiment, the electrically connecting members 52 directly connect with the terminals 53 of the lid member 11. The electrically connecting members 52 electrically connect with the terminals 53 by resistance welding, soldering, or the like. In this structure, the electrically connecting members 52 directly connect with the terminals 53 without via another component such as a connecter. That is, another component such as a connecter need not be interposed between the lid member 11 and the pump module 20, so that the distance among the lid members 11 and the pump module 20 can be reduced. In addition, the electrically connecting members 52 are drawn from the sender gauge 30 substantially perpendicularly with respect to the center axis of the lid member 11. Therefore, the electrically connecting members 52 can be restricted from causing interference with the lid member 11 and the pump module 20. This, the height of the fuel feed apparatus 10 can be reduced.

Furthermore, in this embodiment, the detecting device 31 of the sender gauge 30 is fixed to the housing 28 that accommodates the fuel pump 22. The housing 28 has claw portions 81 on the upper side and lower side thereof. The claw portions 81 on the upper side and lower side interpose the detecting device 31 of the sender gauge 30 thereamong. The detecting device 31 has step portions 34 that can engage with the claw portions 81. In this structure, the claw portions 81 of the housing 28 and the step portions 34 of the detecting device 31 snap fit to and engage with each other. In this embodiment, the claw portions 81 of the housing 28 protrude upwardly and downwardly in FIG. 6 in the substantially depth direction of the fuel tank 1. The step portions 34 are arranged on both vertical end portions of the detecting device 31, corresponding to the claw portions 81. Thus, in this structure, the detecting device 31 is slid substantially along the center axis of the fuel pump 22 substantially in the horizontal direction in FIG. 6, thereby being assembled to the housing 28. Both the vertical end portions of the detecting device 31 in FIG. 6 are fixed by engagement among the claw portions 81 and the step portions 34. Thus, the detecting device 31 can be restricted from chattering vertically in the depth direction of the fuel tank 1. In the structure of the fuel tank 1 in the flat shape, the liquid level does not largely change in the fuel tank 1, even when fuel in the fuel tank increase or decreases. Therefore, the sender gauge 30 needs to accurately detect a small variation in the liquid level in the fuel tank 1. In this structure, chattering is reduced in the detecting device 31, so that accuracy in detecting the liquid level of fuel in the fuel tank 1 can be readily secured. Therefore, the sender gauge 30 can accurately detect a small variation in the liquid level of fuel in the fuel tank 1.

In the fourth embodiment, the structure and the assembling process of the sender gauge 30 are described individually from that in the first to third embodiments. However, for example, the fuel feed apparatus 10 in the first embodiment can be combined with the structure of the sender gauge 30 in the fourth embodiment. That is, the fuel feed apparatus 10 in the first embodiment may include the sender gauge 30 in the fourth embodiment.

Variation

The pipe member in the above embodiments is not limited to the bellows pipe 50. The pipe member may be any other pipes and tubes such as a rubber tube.

The lid member 11 and the pump module 20 may be provided to the sidewall of the fuel tank 11 or the bottom wall of the fuel tank 11, instead of providing the lid member 11 and the pump module 20 to the upper wall 2 of the fuel tank 11.

The fuel pump 22 may be arranged substantially in parallel with the center axis of the lid member 11 and the check valve 40 may be arranged substantially perpendicularly to center axis of the lid member 11, instead of arranging the fuel pump 22 substantially perpendicularly to the center axis of the lid member 11 and arranging the check valve 40 substantially in parallel with the center axis of the lid member 11.

The above structures of the embodiments can be combined as appropriate.

In the above embodiments, the sealing structure is used in the flowmeter. However, the sealing structure is not limited to be used in a flowmeter. The sealing structure can be used for any other accommodating structures.

Various modifications and alternations may be diversely made to the above embodiments without departing from the spirit of the present invention.

What is claimed is:

1. A fuel feed apparatus that pumps fuel in a fuel tank to an outside of the fuel tank, the fuel feed apparatus comprising:

a lid member that covers an opening formed in a wall of the fuel tank, the lid member including an outlet passage, through which fuel passes to the outside of the fuel tank;

a pump module that is accommodated in the fuel tank, the pump module being supported by the lid member, the pump module including a fuel pump for pumping fuel in the fuel tank to the outside of the fuel tank;

a pipe member that connects with a pipe connecting portion of the outlet passage of the lid member and a pipe connecting portion of the pump module, the pump module adapted to discharge fuel to the outlet passage through the pipe member, and an elastic member that is arranged between a bottom wall of the pump module and a bottom wall of the fuel tank for absorbing vibration of the pump module;

a support member that connects a supporting portion of the pump module with the lid member; and a resilient member provided on an outer periphery of the support member, wherein the pipe connecting portion of the outlet passage, the pipe connecting portion of the pump module, and a center axis of the fuel pump are substantially perpendicular to a center axis of the lid member, the fuel pump has a circumferential periphery, which is substantially in parallel with the center axis of the fuel pump, and a portion of the circumferential periphery defines the bottom wall of the pump module and is in contact with the elastic member, and the fuel pump is horizontally arranged in a projection plane of the lid member.

2. The fuel feed apparatus according to claim 1, wherein the pump module includes a base that is arranged on an opposite side of the lid member, the base supports the pump module relative to the bottom wall of the fuel tank, and the elastic member includes a non-woven fabric that is insert-formed in the base.

3. The fuel feed apparatus according to claim 1, further comprising:

a check valve that is provided to a side of a fuel outlet of the fuel pump, wherein the check valve restricts fuel from causing reverse flow to a side of the fuel pump from the outside of the fuel tank, and the check valve has a center axis that is substantially in parallel with the axis of the lid member.

4. The fuel feed apparatus according to claim 1, further comprising:

an electrically connecting portion that connects with the pump module, wherein the electrically connecting portion includes an end portion on an opposite side of the pump module, and the end portion of the electrically connecting portion directly connects with a terminal of the lid member.

5. The fuel feed apparatus according to claim 1, wherein the pump module further includes a sender gauge that detects an amount of fuel remaining in the fuel tank, and the sender gauge is fixed to the pump module in such a manner that the sender gauge is slid substantially along a center axis of the pump module.

6. The fuel feed apparatus according to claim 1, wherein said elastic member spaces said pump module from said bottom wall of the fuel tank.

7. The fuel feed apparatus according to claim 1, wherein the elastic member is sandwiched between the bottom wall of the pump module and the bottom wall of the fuel tank, with respect to an axial direction of the pump module, and the elastic member insulates the bottom wall of the pump module from the bottom wall of the fuel tank.

8. The fuel feed apparatus according to claim 7, wherein the elastic member entirely partitions the bottom wall of the pump module from the bottom wall of the fuel tank.

9. The fuel feed apparatus according to claim 8, wherein the elastic member entirely surrounds the bottom wall of the pump module.

10. A fuel feed apparatus that pumps fuel in a fuel tank to an outside of the fuel tank, the fuel feed apparatus comprising:

a lid member that covers an opening formed in a wall of the fuel tank, the lid member including an outlet passage, through which fuel passes to the outside of the fuel tank;

a pump module that is accommodated in the fuel tank, the pump module being supported by the lid member, the pump module including a fuel pump for pumping fuel in the fuel tank to the outside of the fuel tank; and a pipe member that connects with a pipe connecting portion of the outlet passage of the lid member and a pipe connecting portion of the pump module, the pump module adapted to discharge fuel to the outlet passage through the pipe member, and an elastic member that is arranged between a bottom wall of the pump module and a bottom wall of the fuel tank for absorbing vibration of the pump module;

a support member that connects a supporting portion of the pump module with the lid member; and a resilient member provided on an outer periphery of the support member, wherein the pipe connecting portion of the outlet passage, the pipe connecting portion of the pump module, and a center axis of the fuel pump are substantially perpendicular to a center axis of the lid member, the elastic member insulates the bottom wall of the pump module from the bottom wall of the fuel tank, the fuel pump has a circumferential periphery, which is substantially in parallel with the center axis of the fuel pump, a portion of the circumferential periphery defines the bottom wall of the pump module and is in contact with the elastic member, and the fuel pump is horizontally arranged in a projection plane of the lid member.

11. The fuel feed apparatus according to claim 10, wherein said elastic member spaces said pump module from said bottom wall of the fuel tank.

12. The fuel feed apparatus according to claim 10, wherein the elastic member is sandwiched between the bottom wall of the pump module and the bottom wall of the fuel tank, with respect to an axial direction of the lid member, and the elastic member entirely partitions the bottom wall of the pump module from the bottom wall of the fuel tank.

13. The fuel feed apparatus according to claim 12, wherein the elastic member entirely surrounds the bottom wall of the pump module.

14. The fuel feed apparatus according to claim 1, wherein the pipe member has a first end portion connected with the first connecting portion of the lid member and a second end portion connected with the second connecting portion of the pump module, and the first and second connecting portions are horizontally arranged.

15. The fuel feed apparatus according to claim 14, wherein the first and second connecting portions extend in a direction substantially perpendicular to the center axis of the lid member.

16. The fuel feed apparatus according to claim 1, wherein the resilient member biases the pump module to the bottom wall of the fuel tank via the elastic member.

17. The fuel feed apparatus according to claim 1, wherein the support member is secured to both the supporting portion of the pump module and the lid member.

18. The fuel feed apparatus according to claim 17, wherein the support member is inserted into the supporting portion substantially in a direction parallel with the center axis of the lid member.

19. The fuel feed apparatus according to claim 18, wherein the support member extends substantially linearly in the direction parallel with the center axis of the lid member.

20. The fuel feed apparatus according to claim 10, wherein the pipe member has a first end portion connected with the first connecting portion of the lid member and a second end portion connected with the second connecting portion of the pump module, and the first and second connecting portions are horizontally arranged.

21. The fuel feed apparatus according to claim 20, wherein the first and second connecting portions extend in a direction substantially perpendicular to the center axis of the lid member.

22. The fuel feed apparatus according to claim 10, wherein the resilient member biases the pump module to the bottom wall of the fuel tank via the elastic member.

23. The fuel feed apparatus according to claim 10, wherein the support member is secured to both the supporting portion of the pump module and the lid member.

24. The fuel feed apparatus according to claim 23, wherein the support member is inserted into the supporting portion substantially in a direction parallel with the center axis of the lid member.

25. The fuel feed apparatus according to claim 24, wherein the support member extends substantially linearly in the direction parallel with the center axis of the lid member.

* * * * *